US007426888B2

(12) United States Patent
Hunt

(10) Patent No.: US 7,426,888 B2
(45) Date of Patent: Sep. 23, 2008

(54) FIREARM AMMUNITION FOR TRACKING WOUNDED PREY

(75) Inventor: C. Timothy Hunt, Dadeville, AL (US)

(73) Assignee: T&P Game Recovery, LLC, Dadeville, AL (US)

( * ) Notice: Subject to any disclaimer, the term of this patent is extended or adjusted under 35 U.S.C. 154(b) by 0 days.

(21) Appl. No.: 11/466,667

(22) Filed: Aug. 23, 2006

(65) Prior Publication Data

US 2006/0278116 A1 Dec. 14, 2006

Related U.S. Application Data

(63) Continuation-in-part of application No. 11/219,500, filed on Sep. 2, 2005.

(60) Provisional application No. 60/648,620, filed on Jan. 31, 2005, provisional application No. 60/606,615, filed on Sep. 2, 2004, provisional application No. 60/710,580, filed on Aug. 23, 2005.

(51) Int. Cl.
*F42B 12/40* (2006.01)

(52) U.S. Cl. ..... 102/513

(58) Field of Classification Search ..... 102/513, 102/444, 501, 529
See application file for complete search history.

(56) References Cited

U.S. PATENT DOCUMENTS 3,429,263 A * 2/1969 Lont et al. ..... 102/513
3,649,020 A * 3/1972 Hall ..... 473/569
3,776,137 A * 12/1973 Abbott ..... 102/431
3,911,824 A * 10/1975 Barr et al. ..... 102/502
4,128,059 A * 12/1978 Black ..... 102/513
5,035,183 A * 7/1991 Luxton ..... 102/502
5,565,649 A * 10/1996 Tougeron et al. ..... 102/502
6,419,655 B1 * 7/2002 Nett et al. ..... 604/57
6,619,211 B1 * 9/2003 Haeselich ..... 102/513
6,931,993 B1 * 8/2005 Manole et al. ..... 102/458
2002/0134274 A1 * 9/2002 Martinez et al. ..... 102/513
2003/0159612 A1 * 8/2003 Ziemack ..... 102/512

(Continued)

OTHER PUBLICATIONS

Bayer; Alka-Seltzer-Experience the Power of Effervescent Relief, Online Literature: www.alkaseltzer.com/home/default; Aug. 31, 2004; 1 page.

(Continued)

*Primary Examiner*—James S Bergin
(74) *Attorney, Agent, or Firm*—Gardner Groff Greenwald & Villanueva, PC

(57) ABSTRACT

A firearm ammunition device includes a cartridge with a projectile that is loaded with a tracer agent. When the projectile is fired and strikes a game animal, the impact causes the release and dispersal of the tracer agent from the projectile. The dispersed tracer agent identifies an enhanced-visibility trail of the fleeing animal. In example embodiments, the cartridge is provided by a centerfire cartridge, a shotgun cartridge, and a muzzleloading cartridge. The tracer agent preferably comprises one or more compounds that produce visible light to the naked eye and/or under a black light source. Example tracer agents include biological stains that produce visible light upon contact with blood, luminol or another chemiluminescent compound that releases light by a chemical reaction such as may occur when contacting blood, a basic salt such as sodium carbonate or another effervescence-inducing agent, a phosphorescent compound, or a fluorescent compound.

28 Claims, 2 Drawing Sheets

U.S. PATENT DOCUMENTS

2006/0044792 A1* 3/2006 Dallas et al. ..... 362/184

OTHER PUBLICATIONS

Leber Enterprises, LLC; Bow Hunter's Anectine Pods; Online Literature; ww.turkeytail.com/; Aug. 26, 2004; 4 pages; Madison, Missouri.

Crime Scene; Luminol; Online Literature; www.crimescene.com/store/index.php?main_page=product_info&products_id=49; Dec. 12, 2005; 2 pages.

Risk Reactor; PF-33 Fluorescent Pigment; Online Literature; www.riskreactor.com/Fluorescent_Pigments/Fluorescent_Pigments_Data_Sheets/PF_33; Aug. 22, 2005; 3 pages.

Risk Reactor; Fluorescent Dyes; Online Literature; www.riskreactor.com/Fluorescent_Dyes/Fluorescent_Dyes_Main; Aug. 22, 2005; 1 page.

Risk Reactor; Fluorescent Pigments; Online Literature; www.riskreactor.com/Fluorescent_Pigments/Fluorescent_Dyes_Main; Aug. 22,, 2005; 1 page.

Risk Reactor; Black Lights and UV LEDs; Online Literature; www.riskreactor.com/Black_Lights_UV_LEDs/Black_Lights_UV_LEDs_Main; Aug. 22, 2005; 2 pages.

Risk Reactor; Glow In The Dark Paint; Online Literature; www.riskreactor.com/ Glow_In_The_Dark_Paint/Glow_In_The_Dark_Paint_Main; Aug. 22, 2005; 2 pages; Huntington, California.

Risk Reactor; Glow In The Dark Pigments; Online Literature; www.riskreactor.com/Glow_In_The_Dark_Pigments/Glow_In_The_Dark_Pigments_Main; Aug. 22, 2005; 2 pages; Huntington, California.

Wikipedia; Staining (biology): Online Literature; www.en.wikipedia.org/wiki/Staining; Aug. 10, 2005; 7 pages.

* cited by examiner

FIREARM AMMUNITION FOR TRACKING WOUNDED PREY

CROSS-REFERENCE TO RELATED APPLICATIONS

This application is a continuation-in-part of U.S. patent application Ser. No. 11/219,500 filed Sep. 2, 2005, which claims the priority benefit of U.S. Provisional Patent Application Ser. No. 60/648,620 filed Jan. 31, 2005 and U.S. Provisional Patent Application Ser. No. 60/606,615 filed Sep. 2, 2004, and this application claims the priority benefit of U.S. Provisional Patent Application No. 60/710,580 filed Aug. 23, 2005, all of which are hereby incorporated herein by reference.

TECHNICAL FIELD

The present invention relates generally to hunting wild game and, in particular, to hunting-related devices and methods for tracking wounded game animals.

BACKGROUND OF THE INVENTION

When hunting wild game, hunters aim for a quick and clean kill that puts the animal down right away with little suffering. But even the best hunters do not always achieve this. Sometimes the animal is mortally wounded but still able to flee for a considerable time and distance. This is true for all types of hunting, including hunting with firearms and bows, because it is difficult to achieve a quick and clean kill with a single shot.

When a game animal has been wounded but flees, it can be very difficult to track. Even during the day, the animal's blood can be very difficult to see, for example, on leaves, the bare ground, etc. The problem is compounded during low light conditions, i.e., at night, in early morning, and in late afternoon. The unfortunate result is that the wounded animal suffers unnecessarily due to the longer time required to find it. And all too often the hunter is unable to find or track the blood trail and never finds the game animal, which can result in prolonged animal suffering and a wasteful loss of the animal.

Thus it can be seen that needs exist for improvements to devices and methods for tracking wounded game animals. It is to such improvements that the present invention is primarily directed.

SUMMARY OF THE INVENTION

Generally described, the present invention provides firearm ammunition devices for use when hunting to wound and aid in tracking the wounded, fleeing game animal. The tracking-assist ammunition device includes a tracer agent and a firearm-propelled projectile with a cavity that holds the tracer agent. When the projectile is shot from a firearm and impacts the animal, the tracer agent is released from the projectile cavity and the impact causes the dispersal of the agent. The dispersed tracer agent identifies an enhanced-visibility trail marked by the wounded animal as it flees, which makes it much easier for the hunter to track and find the wounded animal. The ammunition devices may be provided in a number of different embodiments that provide the herein-described functions and benefits, including the following three example embodiments as well as other embodiments not expressly described herein.

In a first example embodiment, the tracking-assist ammunition device includes the tracer agent and a centerfire cartridge for shooting by a rifle. The centerfire cartridge includes a metal casing that holds the projectile along with propellant and primer gunpowder charges, and a ballistic tip that covers the cavity to contain the tracer agent.

In a second example embodiment, the tracking-assist ammunition device includes the tracer agent and a shotgun cartridge for shooting by a shotgun. The shotgun cartridge includes a crimped-end casing that holds the projectile along with propellant and primer gunpowder charges, and a ballistic tip that covers the cavity to contain the tracer agent.

In a third example embodiment, the tracking-assist ammunition device includes the tracer agent and a muzzleloading cartridge for shooting by a blackpowder muzzleloading firearm. The muzzleloading cartridge includes a base-like casing that is coupled to the projectile, without any integral gunpowder charges, and a ballistic tip that covers the cavity to contain the tracer agent.

The tracer agent is selected for being easily released and dispersed when the projectile strikes the animal, and for the creating a highly visible (or otherwise easily detectable) trail upon such dispersal. In one aspect, the tracer agent includes a biological stain that interacts with the animal's blood to produce light. For example, the biological stain may be Bismarck brown, carmine, coomassie blue, crystal violet, DAPI, eosin, ethidium bromide, fuchsin, haematoxylin, Hoeschst stain, iodine, malchite green, methyl green, methylene blue, neutral red, Nile blue, rhodamine, safranin, or a mixture thereof.

In another aspect, the tracer agent includes a chemiluminescent compound that releases light as the result of a chemical reaction such as interacting with the animal's blood. The chemiluminescent compound may be bis-(2,4,6-trichlorophenyl) oxlate (TCPO), bis-(2,4-dinitrophenyl)oxalate (DNPO), fluorescein, luminol, or a mixture thereof. Such tracer agents are well suited for use at night.

In yet another aspect, the tracer agent includes a phosphorescent compound. The phosphorescent compound may be a commercially available glow-in-the dark paint or pigment. Such tracer agents are well suited for use at night.

In still another aspect, the tracer agent includes an effervescence-inducing agent. The effervescence-inducing agent may be a basic salt such as sodium carbonate, sodium bicarbonate, or ALKA-SELZER® brand antacid or another substance including baking soda and citric acid. Such tracer agents are well suited for use during daylight.

In a further aspect, the tracer agent includes a fluorescent pigment or dye. The fluorescent pigment or dye may be a commercially available type such as PF33 orange or another pigment or dye that produces light with or without interacting with the animal's blood and that comprises an organic compound or a metal complex incorporated into a resin such as a melamine formaldehyde sulphonamide resin. These and other included agents produce visible light to the naked eye in the daylight and at night upon exposure to a black light source.

In addition, in another aspect the present invention includes a hunting method for wounding and tracking an animal. The method includes providing a cartridge with a firearm-propelled projectile having a cavity loaded with a tracer agent; shooting the animal with the projectile so that the agent is dispersed to identify an enhanced-visibility trail marked by the wounded animal as it flees; and following the enhanced-visibility trail. When the projectile hits the animal, the projectile wounds the animal and the impact forces the projectile to a dispensing position (with the ballistic tip displaced and the flange around the cavity in an expanded, mushroom-like shape) and releases the tracer agent for dispersal.

Also, the tracer agent may be a type that interacts with the animal's blood to produce enhanced-visibility properties, in which case the step of following the enhanced-visibility trail includes following the enhanced-visibility trail left by the animal's enhanced-visibility blood. Alternatively, the tracer agent may be a type that produces enhanced-visibility properties regardless of interaction with the animal's blood, in which case the step of following the enhanced-visibility trail includes following the enhanced-visibility trail of the tracer agent itself. In this case, the step of following the enhanced-visibility trail includes following a first portion of the enhanced-visibility trail identified by a first portion of the tracer agent that disperses onto the ground, fallen leaves, trees, bushes, and/or any other surroundings after the dispenser impacts the animal and until the animal starts bleeding out of the wound. And the trail-following step further includes following a second portion of the enhanced-visibility trail identified by a second portion of the agent that combines with the animal's flowing blood and disperses onto surroundings as the animal continues to flee.

Furthermore, in another aspect the present invention includes a method of assembling a kit for use in hunting to wound and track an animal. The method includes providing a tracer agent; providing an unassembled cartridge including a firearm-propelled projectile having a cavity; and packaging the tracer agent and the cartridge components together for assembly by the hunter. In addition, the method may include providing an enhanced visibility enabling device, such as a black light source, and packaging it with the unassembled cartridge kit or packaging it with a quantity of assembled agent-laden cartridges.

Accordingly, the present invention provides devices and methods for use to create an enhanced-visibility trail that aids in tracking a wounded fleeing game animal. The tracer agents and the projectiles used in the various embodiments of the invention permit tracking wounded game animals in daylight conditions, in nighttime and other low-light conditions, during or after rainy weather, and/or over several days.

The specific techniques and structures employed by the invention to improve over the drawbacks of the prior devices and accomplish the advantages described herein will become apparent from the following detailed description of the example embodiments of the invention and the appended drawings and claims.

DETAILED DESCRIPTION OF EXAMPLE EMBODIMENTS

The present invention may be understood more readily by reference to the following detailed description of the invention taken in connection with the accompanying drawing figures, which form a part of this disclosure. Generally described, the present invention includes firearm ammunition devices for use by hunters to assist in tracking wounded prey. The tracking-assist ammunition devices each include a tracer agent and firearm-propelled projectile for carrying and dispensing the agent. The projectile is designed to release the tracer agent when it strikes the targeted game animal. The tracer is selected for dispersing from the projectile and identifying an enhanced-visibility trail of the wounded game. As used herein, an "enhanced-visibility trail" is a trail marked by a wounded, fleeing animal that is easier to see or otherwise detect than the animal's ordinary blood trail alone.

Figure 1:
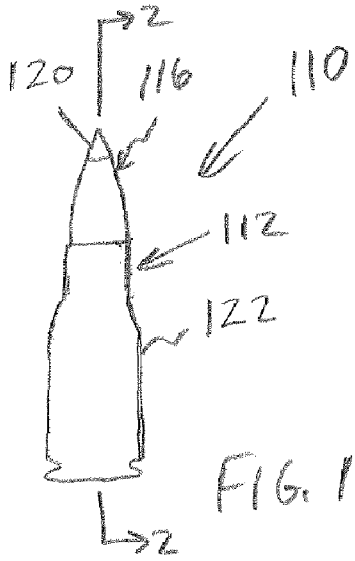
FIG. 1 is a side view of an ammunition device according to a first example embodiment of the present invention, showing a centerfire cartridge including a projectile.
Figure 2:
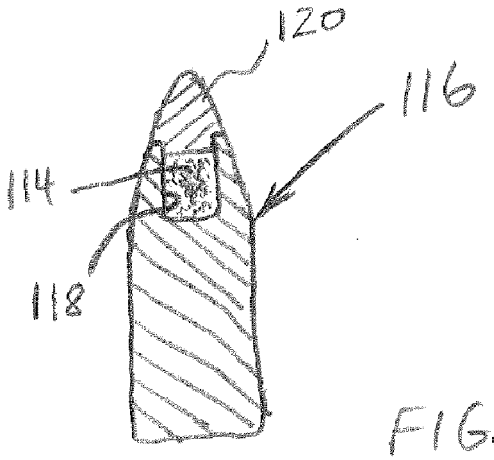
FIG. 2 is a cross-section view of the projectile taken at line 2-2 of FIG. 1, showing a cavity loaded with a tracer agent.

With reference now to the appended drawings, FIGS. 1 and 2 show a tracking-assist ammunition device 110 according to a first example embodiment of the invention. The device 110 includes a firearm-actuated cartridge 112 and a tracer agent 114. The cartridge 112 includes an agent-dispensing projectile 116 defining a cavity 118 for the agent 114, a ballistic tip 120 that removably covers the cavity, and a casing 122 for holding the projectile. The projectile 116 and tip 120 are designed to release the tracer agent 114 when the projectile strikes the targeted game animal.

Generally speaking, the tracer agent 114 is preferably selected for being easily released and dispersed about upon the impact of the projectile 116 striking the animal, and for the creating a highly visible trail upon such dispersal. The tracer agent 114 as defined herein can be one or more compounds that produce visible light either to the naked eye or with the use of a light source (e.g., black light) upon contact with the animal. For example, upon contact of the tracer agent with the animal (e.g., skin, hair, blood), the tracer agent emits visible light (i.e., color) that can be readily detected by the un-aided eye. Thus, in one aspect, the tracer agent is a compound that possesses visible color. In another aspect, the tracer agent can be a colorless compound that is converted to a colored species upon contact with the animal. Alternatively, the tracer agent can be a compound that can be detected once it is exposed to black light. In a further aspect, the tracer agent can interact with the skin or blood of the animal to make the blood or skin of the animal more visible to the naked eye. In this aspect, the tracer agent can interact with the blood or skin and form a bond such as, for example, a covalent, electrostatic, hydrogen or ionic bond to render the skin or blood more visible. In this way, the agent that interacted with the blood leaves an enhanced-visibility blood trail for the hunter to track, and/or the agent that interacted with blood, skin, or hair still present on the animal can help the hunter identify the current location of the animal.

In one aspect, the tracer agent 114 can interact and enhance the visibility of the animal's blood upon contact between the blood of the animal and the tracer agent, thereby making it easier to track the animal by its enhanced-visibility blood trail. For example, the tracer agent can be a biological stain that upon contact with the blood of the animal produces visible light. Examples of biological stains include, but are not limited to, Bismarck brown, carmine, coomassie blue, crystal violet, DAPI, eosin, ethidium bromide, fuchsin, haematoxylin, Hoeschst stain, iodine, malchite green, methyl green, methylene blue, neutral red, Nile blue, rhodamine, or safranin. Depending upon the selection of the stain, the stain can selectively bind to proteins, oligonucleotide (e.g., DNA, RNA), blood cells, and other biological components present in blood, and fluoresce.

In another aspect, the tracer agent 114 can be a chemiluminescent compound. Chemiluminescent compounds are compounds that release light due to the occurrence of a chemical reaction. Examples of chemiluminescent compounds include, but are not limited to, bis-(2,4,6-trichlorophenyl)oxiate (TCPO), bis-(2,4-dinitrophenyl) oxalate (DNPO), fluorescein, or luminol. In the case of luminol, which is a commercially available substance that is commonly used in the field of law enforcement, the luminol is typically provided in dry powder form and mixed with water then sprayed on a surface to detect the presence of blood. When used with the tracking-assist ammunition device 110 described herein, the luminol can be loaded into the projectile 116 in a straight powder form, which intensifies the luminescent glowing effect and makes it last significantly longer than when diluted with water. In this aspect, when a hunter shoots an animal with a projectile 116 loaded with the tracer agent 114, the luminol comes into contact with the blood and causes it to glow in the dark a bright fluorescent blue, which enhances the visibility of the blood trail so it is easier to follow, thereby aiding in the tracking of the animal. In various aspects, the chemiluminescent compound is particularly well suited for use at night.

In yet another aspect, the tracer agent 114 can be a phosphorescent compound. Examples of phosphorescent compounds described in WO 98/55561, WO 00/18851, WO 00/57676, WO 00/70655, and U.S. Pat. No. 6,579,632, which are incorporated by reference, can be used as the tracer agent. In one aspect, the glow-in-the-dark paints and pigments manufactured by RISK REACTOR (Huntington Beach, Calif.) can be used herein. In various aspects, the phosphorescent compound is particularly well suited for use at night.

In still another aspect, the tracer agent 114 can be an effervescence-inducing agent such as, for example, a basic salt. Examples of effervescence-inducing agents include, but are not limited to, sodium carbonate, sodium bicarbonate, or ALKA-SELZER® brand antacid or another substance including baking soda and citric acid. Not wishing to be bound by theory, it is believed that when the animal's blood (e.g., highly oxygenated blood from a shot to the lungs) comes into contact with the effervescence-inducing agent, the interaction makes the red blood effervescent and thus become a thick, frothy consistency with a pink coloration. When used with the tracking-assist ammunition device 110 described herein, the effervescence-inducing agent can be loaded into the projectile 116 in a straight powder form, which intensifies the pink bubbling effect and makes it last significantly longer than when diluted with water. In this way, when a hunter shoots an animal with a projectile 116 loaded with the tracer agent 114, the effervescence-inducing agent comes into contact with the blood and causes it to foam up and turn bright pink, which enhances the visibility of the blood trail so it is easier to follow, thereby aiding in the tracking of the animal. In this aspect, the use of the effervescence-inducing agent as the tracer agent is well suited for use during daylight.

In another aspect, the tracer agent 114 can be a fluorescent compound. In one aspect, the fluorescent compound is a colored pigment or dye. Fluorescent dyes and pigments are known in the art and can be used herein. For example, the pigment or dye can be an organic compound (e.g., aromatic and heteroaromatic compounds) or metal complexes (e.g., transition metal complexes and metal oxides). The fluorescent dyes and pigments manufactured by RISK REACTOR (Huntington Beach, Calif.) can be used herein, some with better results than others. For example, the fluorescent compound can be orange PF33 available from RISK REACTOR. This fluorescent agent is well suited because when it contacts blood, the blood-agent combination still fluoresces, unlike many other known dyes and pigments. This bright orange powder is extremely visible to the naked eye in the daylight and, with the assistance of a black light, glows very well in the orange color at night. When the tracer agent 114 is orange PF33 or a similar pigment, the tracking-assist ammunition device 110 can be used in day or night conditions. In addition, the color and fluorescent effect of the tracer agent 114 can last several days, so if an animal is shot with the ammunition device 110 in daylight conditions, when darkness falls, the animal can be tracked and found hours or even days later. For example, the orange PF33 pigment has been found to glow for four days in testing. Furthermore, the orange PF33 or a similar fluorescent agent does not dissolve in water, and it still fluoresces when it contacts water, unlike some other known dyes and pigments.

In the case of orange PF33 and similar fluorescent pigments and dyes, these agents do not interact with the animal's blood to produce visible light, but instead produce visible light due to the physical properties of the pigment or dye. Thus, the fluorescent agent glows under black light, with or without the blood, and it is the glow of the agent that leads the hunter to the animal. This facilitates tracking the animal. The spot where the animal is at when shot might be quite some distance away from the hunter, so generally the impact spot can be difficult to identify. Typically, the animal will take off running right away and it will be a number of yards (e.g., about 20 to 50 yards for some deer) until it bleeds out enough to leave a blood trail. So sometimes the hunter never finds the blood trail and thus never finds the animal. But using the orange PF33 or similar fluorescent pigments and dyes overcomes this problem. The fluorescent agent is dispensed from the projectile at impact and it splatters about onto the animal, any nearby trees and/or bushes, the ground, and any other surroundings. The agent that is dispersed onto the ground, trees, bushes, etc. identifies the location of the animal at impact and thus identifies the beginning of the enhanced-visibility trail, so that the hunter can easily find the spot where the animal began fleeing. In addition, as the animal flees the spot but before it is bleeding out from the wound, the agent that is dispersed onto the animal can rub off on any trees, bushes, etc. to identify a first portion of the enhanced-visibility trail. After a number of yards (e.g., about 20 to 50 yards for some deer), the animal's blood flows sufficiently from the wound and over the projectile so that the blood-carried agent rubs off on any trees and bushes and/or drips to the ground to identify a second portion of the enhanced-visibility trail.

Figure 7:
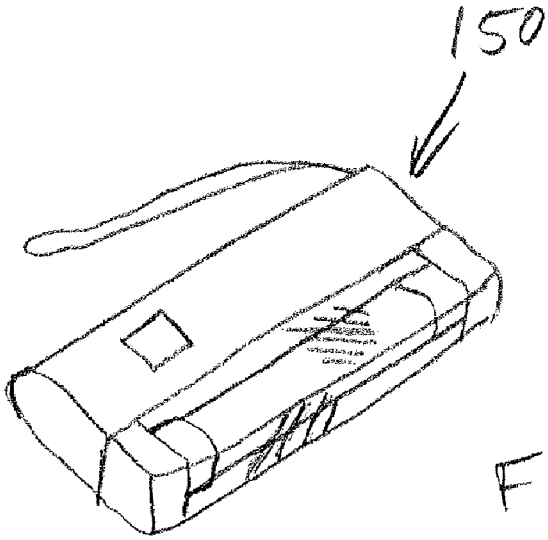
FIG. 7 is a perspective view of a portable black light unit for use in detecting certain tracer agents included in the invention.

As mentioned herein, the orange PF33 and similar fluorescent pigments and dyes glow very well at night under black light. Commercially available portable black lights 150 (see FIG. 7) can be used to detect the fluorescent agent or similar agents that glow under black light, such as the hand-held high power 9 blue LED black lights available from "DUCO TECHNOLOGIES INC." (Henderson, Nev.). The black light 150 can be packaged and sold together with a quantity of the tracking-assist ammunition devices 110 as a kit, or these components can be provided separately. The light source may be adapted for wearing (e.g., with a strap for securing on the hunter's head), for mounting onto a firearm, or otherwise adapted for conveniently carrying and directing the light source towards the enhanced-visibility trail. Furthermore, it is contemplated to provide enhanced-visibility enabling devices other than black lights, such as goggles or other devices having an optic lens with a filter, or a pair of optic lenses with a gas sealed between them, with the tracer agent being one or more compounds that glow or otherwise have enhanced-visibility properties when viewed through the lenses.

It will be understood that the tracer agent 114 can be used in dry form (e.g., powder, granules, etc.) or in liquid form (e.g., mixed with a solvent including, but not limited to, water, an organic solvent, or a mixture thereof). Alternatively, the tracer agent can be incorporated into or part of a polymer matrix. For example, the dye or pigment can be incorporated into a resin including, but not limited to, a melamine formaldehyde sulphonamide resin. In addition, the amount of tracer agent can also vary depending upon the targeted animal and the desired intensity of the visible signal to be detected by the hunter. Furthermore, various of the herein-described tracer agents can be used in combination. For example, a first agent can be loaded into the bottom of the projectile cavity and a second agent loaded on top of the first one, or the agents can be mixed together and then loaded into the cavity. Thus, the first agent may be selected for daytime visibility and the second one for nighttime visibility, the first one for high visibility without the presence of blood and the second one for high visibility upon mixing with blood, etc. Moreover, it is contemplated that other components can be used in combination with the tracer agent to facilitate the tracking of the animal including, but not limited to, odor- or sound-inducing agents.

Figure 8:
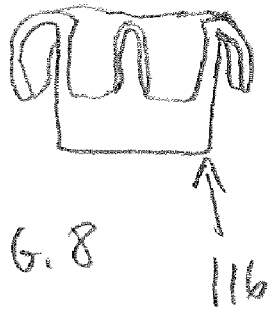
FIG. 8 is a side view of the projectile of FIG. 1, showing the projectile in the dispensing position with the ballistic tip displaced and the projectile mushroomed open.

As described above, the tracer agent 114 is delivered to a target game animal by a cartridge 112. In the embodiment depicted in FIG. 1, the cartridge 112 is provided by a conventional centerfire bullet for shooting by a rifle. The centerfire cartridge 112 includes a metal casing 122 holding a propellant gunpowder charge (not shown), a primer gunpowder charge (not shown), and a conventional hollow-point slug or projectile 116. The hollow front end of the projectile 116 defines a cavity 118 that is covered by a ballistic tip 120. In the conventional use of a hollow-point projectile 116, when the projectile strikes a target, the increased pressure in the collapsing cavity 118 causes the metal flange around it to expand outwardly into a mushroom-like shape with an increased surface area for causing greater damage. In the present invention, the tracer agent 114 is loaded into the cavity 11 8 for dispersal when the projectile 116 strikes its target and mushrooms (see FIG. 8). Thus, the projectile 116 provides the dual functions of causing injury and dispersing the agent 114.

As shown more particularly in FIG. 2, the projectile 116 defines the cavity 118 into which the agent 114 is loaded. The ballistic tip 120 is fitted over the cavity 118 at the front end of the projectile 116 with a snug fit so that the tip is held securely in place during normal handling of the cartridge 110 to hold the agent 114 in the cavity, and so that the tip is displaced from the projectile upon impact with the animal when shot from the firearm, thereby allowing the agent to be dispersed from the cavity. It will be understood that conventional or customized hollow-point projectile slugs and ballistic tips may be used. For example, suitable conventional hollow-point projectile slugs 116 and ballistic tips 120 are commercially available from REMINGTON ARMS COMPANY, INC. of Madison, N.C.; NOSLER, INC. of Bend, Oreg.; and other manufacturers well known in the firearm ammunition industry. The hollow-point projectile slugs 116 are preferably made of lead, an amalgam, or another material for carrying out the dual functions mentioned above. The ballistic tip 120 is preferably made of a polymer or other material that, upon impact, is displaced from the tip of the projectile slug 116 so that it allows the agent to be dispersed from the cavity 118. It will be understood that variations (in shapes, dimensions, materials, etc.) in these components can be used for ballistic performance and individual hunter preferences.

Figure 3:
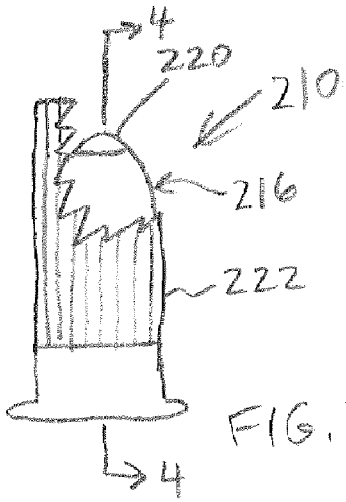
FIG. 3 is a partially cutaway side view of an ammunition device according to a second example embodiment of the present invention, showing a shotgun cartridge including a projectile.
Figure 4:
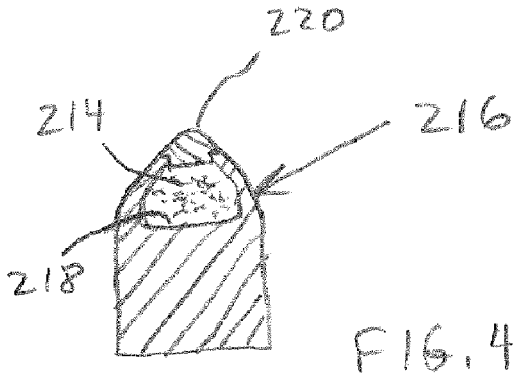
FIG. 4 is a cross-section view of the projectile taken at line 4-4 of FIG. 3, showing a cavity loaded with a tracer agent.

Turning now to FIGS. 3 and 4, there is illustrated a tracking-assist ammunition device 210 according to a second example embodiment. The ammunition device 210 is similar to that just described. In this embodiment, however, the cartridge 212 is provided by a conventional shotgun shell for shooting by a shotgun. Accordingly, the cartridge 212 includes a crimped-end casing 222 holding a propellant gunpowder charge (not shown), a primer gunpowder charge (not shown), and a conventional hollow-point slug or projectile 216. The hollow front end of the projectile 216 defines a cavity 218 that is covered by a ballistic tip 220, and the tracer agent 214 is loaded into the cavity 218 for dispersal when the projectile 216 strikes its target and mushrooms. The tracer agent 214 is similar to that described herein.

Figure 5:
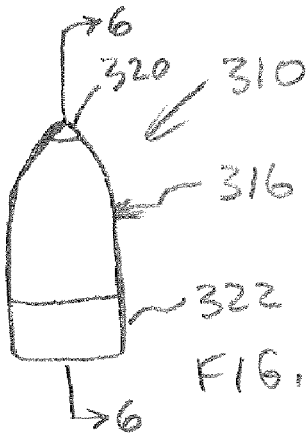
FIG. 5 is a side view of an ammunition device according to a second example embodiment of the present invention, showing a muzzleloading cartridge including a projectile.
Figure 6:
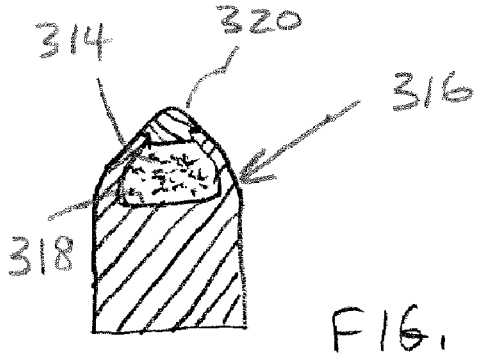
FIG. 6 is a cross-section view of the projectile taken at line 6-6 of FIG. 5, showing a cavity loaded with a tracer agent.

Turning now to FIGS. 5 and 6, there is illustrated a tracking-assist ammunition device 310 according to a third example embodiment. The ammunition device 310 is similar to those just described. In this embodiment, however, the cartridge 312 is provided by a conventional muzzleloading bullet for shooting by a blackpowder muzzleloading firearm. Accordingly, the cartridge 312 includes a casing 322 coupled to a conventional hollow-point slug or projectile 316. As a blackpowder muzzleloading bullet, the propellant and primer gunpowder charges are not integrally provided with the bullet. And the casing 322 is provided by a base, for example, a plastic, snap-on base for creating a gas seal. The hollow front end of the projectile 316 defines a cavity 318 that is covered by a ballistic tip 320, and the tracer agent 314 is loaded into the cavity 318 for dispersal when the projectile 316 strikes its target and mushrooms. The tracer agent 314 is similar to that described herein.

Figure 9:
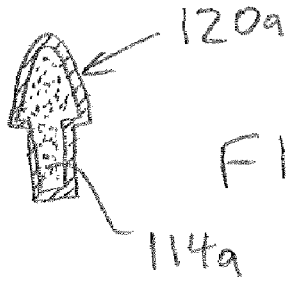
FIG. 9 is a longitudinal cross-section view of a ballistic tip according to an alternative embodiment of the present invention, showing a pre-formed hollow tip loaded with the tracer agent.

In the embodiments described, the projectile is provided by conventional hollow-point slugs. As used herein, a hollow-point projectile or slug includes any firearm-propelled projectile having a cavity into which the tracer agent can be loaded and held during handling and firing, and then dispersed from upon impact. Thus, the present invention contemplates providing the projectiles by commercially available hollow-point slugs as well as by customized slugs that have a cavity and a separate or integral cover of any type that is adapted for holding the tracer agent in the cavity. FIG. 9 shows a ballistic tip **120*a* according to one such alternative embodiment, which is for use with the projectile 116 of FIG. 2. This ballistic tip 120*a* is hollow with the tracer agent 114*a* loaded into it during manufacture, and is designed with a strength so that it does not burst during handling and firing but does burst upon striking the animal, thereby releasing the agent. Thus, the leading, exposed (extending out of the cavity) wall of the ballistic tip 1 20*a* may be made thicker and/or harder than the unexposed (within the cavity) wall. The ballistic tip 120*a*** is sized and shaped to fill the cavity of the projectile, so a greater amount of the agent can be carried by the projectile than when using a conventional ballistic tip. Alternatively, a similar ballistic tip loaded with the agent may be mounted onto a projectile without a cavity. In another such alternative embodiment, instead of a separate tip covering the cavity, the projectile is designed so that the flange around the cavity can be crimped to close the open front end of the cavity and to fracture upon striking the animal, thereby releasing the agent. In yet another alternative embodiment, the projectile is adapted to mushroom outwardly more than in conventional hollow-point slugs, for enhanced dispersal of the agent, as well as to offset any possible loss in mushrooming due to the cavity not being empty. In still other alternative embodiments, the cavity is defined at the sides or back of the projectile and/or the projectile has multiple cavities. And in further alternative embodiments, the projectile is designed so that it does not expand and mushroom, though the agent is still dispensed by the displacement of the ballistic tip. Thus, in some embodiments the projectile is altered to the dispensing position by only the displacement of the ballistic tip, and in some other embodiments the projectile is altered to the dispensing position by only the expansion and mushrooming of the projectile.

The ammunition devices are typically sold ready for use with the tracer agent pre-loaded into the projectile. In other embodiments the projectile and the tracer agent are sold as a kit or separately and the hunter loads the tracer agent into the projectile. Furthermore, the invention can be implemented in a variety of different embodiments for use by hunters using different types of firearms, including rifles, shotguns, muzzle-loading blackpowder guns, handguns, and other types of firearms. Moreover, the invention can be adapted for use law enforcement or military personnel, with the agent being selected for identifying a trail marked by a fleeing person who was shot by the projectile. Preferably, a standardized, permanent color agent is used so that medical personnel can easily recognize a person who is fleeing from law enforcement officers by the splatter of the agent on the person.

In alternative embodiments, the cartridge is provided by conventional handgun ammunition, rimfire ammunition, or other ammunition for being shot by any type of firearm. In other alternative embodiments, the ammunition device is provided by caseless ammunition. In addition, the projectile slugs may be SABOT-style slugs or non-SABOT-style slugs, as may be desired for individual preferences. It will be understood that the cartridge may be provided in any caliber or gauge that may be desired.

The present invention also provides methods of tracking a wounded animal. The methods include the steps of providing an ammunition device with a projectile having a cavity loaded with a tracer agent, shooting the animal with the ammunition device wherein the projectile wounds the animal and releases the tracer agent for dispersal thereby identifying an enhanced-visibility trail marked by the fleeing animal, and following the enhanced-visibility trail. The tracer agent and the projectile used in the method may be any of those described herein.

For tracer agents that interact with the animal's blood to produce visible light or other enhanced-visibility properties (e.g., luminol, antacids, or blood stains), the step of following the enhanced-visibility trail includes following the enhanced-visibility trail left by the animal's enhanced-visibility blood. And for tracer agents that produce an enhanced-visibility property such as visible light with or without interacting with the animal's blood (e.g., orange PF33 fluorescent pigment), the step of following the enhanced-visibility trail includes following the enhanced-visibility trail of the agent itself. In this case, the hunter follows a first portion of the enhanced-visibility trail identified by a first portion of the agent that disperses onto the surroundings (e.g., trees, bushes, and the ground) after the projectile impacts the animal and until the animal starts bleeding out of the wound. And the hunter follows a second portion of the enhanced-visibility trail identified by a second portion of the agent that combines with the animal's flowing blood and disperses onto trees, bushes, the ground, or other surroundings as the animal continues to flee. The second portion of the enhanced-visibility trail is typically extremely easy to track, while the first portion of the enhanced-visibility trail enables the hunter to find the easily tracked second portion of the trail.

The present invention also provides kits and methods of assembling kits for use in hunting to track wounded game. The method include the steps of providing a cartridge that has a projectile with a cavity, providing a tracer agent selected for dispersing from the projectile cavity and identifying an enhanced-visibility trail marked by a fleeing wounded animal, and packaging these components together in an unassembled state for sale as a kit. The method may further include the step of providing an enhanced visibility enabling device such as a black light source and packaging it with the tracer agent and a quantity of the unassembled cartridge components or packaging it with a quantity assembled agent-laden cartridges. The tracer agent, the cartridge, and the light source used in the method may be any of those described herein.

Accordingly, it can be seen that the present invention provides advantages over conventional hunting gear and methods. Advantageously, the present invention provides devices and methods of creating an enhanced-visibility trail for tracking a wounded fleeing game animal. In the example embodiments described herein, the enhanced-visibility trail can be used for tracking wounded game animals in daylight conditions, in nighttime and other low-light conditions, during or after rainy weather, and/or over several days.

It is to be understood that this invention is not limited to the specific devices, methods, conditions, or parameters described and/or shown herein, and that the terminology used herein is for the purpose of describing particular embodiments by way of example only and is not intended to be limiting of the claimed invention. Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

While the invention has been described with reference to preferred and example embodiments, it will be understood by those skilled in the art that a variety of modifications, additions and deletions are within the scope of the invention, as defined by the following claims.

What is claimed is:

1. A firearm ammunition device for wounding and aiding in tracking an animal, the device comprising:

a firearm-propelled projectile defining a cavity, wherein the projectile is lethal and compels the animal to flee when the animal is shot by the projectile but does not die immediately, and wherein the projectile is altered to a dispensing position when the projectile strikes and mortally wounds the animal; and a tracer agent loaded into the cavity and released when the projectile is altered to the dispensing position, wherein the tracer agent is adapted so that upon release it disperses onto the animal and onto its surroundings over an extended time and over an extended distance to identify an enhanced-visibility impact site and an enhanced-visibility trail over the extended distance leading away from the impact site to aid in tracking the mortally wounded but fleeing animal.

2. The device of claim 1, wherein the tracer agent comprises a biological stain.

3. The device of claim 2, wherein the biological stain comprises Bismarck brown, carmine, coomassie blue, crystal violet, DAPI, eosin, ethidium bromide, fuchsin, haematoxylin, Hoeschst stain, iodine, malchite green, methyl green, methylene blue, neutral red, Nile blue, rhodamine, safranin, or a mixture thereof.

4. The device of claim 1, wherein the tracer agent comprises a chemiluminescent compound.

5. The device of claim 4, wherein the chemiluminescent compound comprises bis-(2,4,6-trichlorophenyl) oxlate (TCPO), bis-(2,4-dinitrophenyl)oxalate (DNPO), fluorescein, luminol, or a mixture thereof.

6. The device of claim 1, wherein the tracer agent comprises a phosphorescent compound.

7. The device of claim 1, wherein the tracer agent comprises an effervescence-inducing agent that effervesces upon interaction with the mortally wounded animal's blood to produce an enhanced-visibility effect for identifying the enhanced-visibility trail over the extended distance.

8. The device of claim 1, wherein the tracer agent comprises a fluorescent pigment or dye.

9. The device of claim 8, wherein the fluorescent pigment or dye comprises an organic compound or a metal complex.

10. The device of claim 9, wherein the fluorescent pigment or dye is incorporated into a resin.

11. The device of claim 10, wherein the resin comprises a melamine formaldehyde sulphonamide resin.

12. The device of claim 1, wherein the tracer agent is provided in a dry form.

13. The device of claim 1, wherein the tracer agent interacts with the mortally wounded animal's blood to produce an enhanced-visibility effect for identifying the enhanced-visibility trail over the extended distance.

14. The device of claim 1, wherein the tracer agent comprises one or more compounds that produce visible light to the naked eye or upon exposure to a light source upon contact with the animal.

15. The device of claim 1, further comprising a ballistic tip fitted over the cavity, wherein the ballistic tip is displaced from the projectile upon striking the animal.

16. The device of claim 15, wherein the ballistic tip is at least partially hollow, contains the tracer agent, and is adapted to burst upon striking the animal.

17. The device of claim 1, further comprising a casing coupled to the projectile.

18. The device of claim 1, wherein the projectile is a centerfire slug, a shotgun slug, or a black powder muzzleloading slug.

19. A kit for use in hunting to wound and track an animal, comprising a plurality of the ammunition devices of claim 1 packaged together with an enhanced visibility enabling device.

20. The kit of claim 19, wherein the enhanced visibility enabling device comprises a black light source.

21. A hunting method for wounding and tracking an animal, comprising:

providing an ammunition device according to claim 1;

shooting the animal with the ammunition device, wherein the projectile mortally wounds the animal but does not immediately kill it and instead compels it to flee, is altered to the dispensing position, and releases the tracer agent, and wherein the released tracer agent disperses onto the animal and onto its surroundings over an extended time and over an extended distance and identifies an enhanced-visibility impact site and an enhanced-visibility trail over the extended distance marked by the mortally wounded animal as it flees; and following the enhanced-visibility trail over the extended distance to pursue the mortally wounded animal.

22. The hunting method of claim 21, wherein the tracer agent interacts with the mortally wounded animal's blood to produce enhanced-visibility properties for identifying the enhanced-visibility trail over the extended distance, and the step of following the enhanced-visibility trail includes following the enhanced-visibility trail left by the animal's enhanced-visibility blood.

23. The hunting method of claim 21, wherein the tracer agent produces enhanced-visibility properties regardless of interaction with the animal's blood, and the step of following the enhanced-visibility trail includes following the enhanced-visibility trail of the tracer agent itself.

24. The hunting method of claim 23, wherein the step of following the enhanced-visibility trail further includes following a first portion of the enhanced-visibility trail identified by a first portion of the tracer agent that disperses onto the surroundings after the projectile impacts the animal and until the animal starts bleeding out of the wound, and following a second portion of the enhanced-visibility trail identified by a second portion of the agent that combines with the animal's flowing blood and disperses onto the surroundings as the animal continues to flee.

25. A firearm ammunition device for wounding and aiding in tracking an animal, the device consisting of:

a firearm-propelled projectile defining a cavity, wherein the projectile is lethal and compels the animal to flee when the animal is shot by the projectile but does not die immediately, and wherein the projectile is altered to a dispensing position when the projectile strikes and mortally wounds the animal; and a tracer agent loaded into the cavity and released when the projectile is altered to the dispensing position, wherein the tracer agent is adapted so that upon release it disperses onto the animal and onto its surroundings over an extended time and over an extended distance to identify an enhanced-visibility impact site and an enhanced-visibility trail over the extended distance to aid in tracking the mortally wounded but fleeing animal.

26. The device of claim 25, wherein the tracer agent interacts with the mortally wounded animal's blood to produce an enhanced-visibility effect for identifying the enhanced-visibility trail over the extended distance.

27. A hunting method for wounding and tracking an animal, consisting of:

providing an ammunition device according to claim 25;

shooting the animal with the ammunition device, wherein the projectile mortally wounds the animal but dies not immediately kill it and instead compels it to flee, is altered to the dispensing position, and releases the tracer agent, and wherein the released tracer agent disperses onto the animal and onto its surroundings over an extended time and over an extended distance and identifies an enhanced-visibility impact site and an enhanced-visibility trail over the extended distance marked by the mortally wounded animal as it flees; and following the enhanced-visibility trail over the extended distance to pursue the mortally wounded animal.

28. The hunting method of claim 27, wherein the step of following the enhanced-visibility trail further includes following a first portion of the enhanced-visibility trail identified by a first portion of the tracer agent that disperses onto the surroundings after the projectile impacts the animal and until the animal starts bleeding out of the wound, and following a second portion of the enhanced-visibility trail identified by a second portion of the agent that combines with the animal's flowing blood and disperses onto the surroundings as the animal continues to flee.

* * * * *